US006322596B1

(12) United States Patent
Kish et al.

(10) Patent No.: US 6,322,596 B1
(45) Date of Patent: Nov. 27, 2001

(54) METHOD OF DECOLORIZING A DYED MATERIAL IN A PREDETERMINED PATTERN

(75) Inventors: Teri Taylor Kish, Alpharetta; Elizabeth Deibler Gadsby, Marietta, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/490,995

(22) Filed: Jan. 25, 2000

Related U.S. Application Data

(60) Provisional application No. 60/117,443, filed on Jan. 26, 1999.

(51) Int. Cl.[7] ..... C09B 67/00

(52) U.S. Cl. ..... 8/401; 8/101; 8/115.51; 8/636; 347/1; 347/95; 347/102

(58) Field of Search ..... 8/101, 115.51, 8/401, 636; 347/1, 95, 102

(56) References Cited

U.S. PATENT DOCUMENTS

| | | | |
|---|---|---|---|
| 4,156,657 | 5/1979 | Lin | 252/188.3 R |
| 4,213,717 | 7/1980 | Lin | 401/18 |
| 4,227,930 | 10/1980 | Lin | 106/19 |
| 4,228,028 | 10/1980 | Lin | 252/188.3 R |
| 4,413,266 | 11/1983 | Aviram et al. | 346/21 |
| 5,480,801 | 1/1996 | Wahleithner et al. | 435/254.3 |
| 5,770,419 | 6/1998 | Feng et al. | 435/189 |

FOREIGN PATENT DOCUMENTS

| | | | |
|---|---|---|---|
| 0757731 B1 | 9/1998 | (EP) | D06P/1/00 |
| 0778907 B1 | 9/1998 | (EP) | D06P/1/00 |
| 0580707 B1 | 7/1997 | (EP) | D06P/5/00 |
| 96/10079 | 4/1996 | (WO) | C12N/9/02 |
| 98/27197 | 6/1998 | (WO) | C12N/9/02 |
| 98/27198 | 6/1998 | (WO) | C12N/9/02 |
| 98/05816 | 2/1998 | (WO) | D06P/1/00 |
| 96/12845 | 5/1996 | (WO) | D06P/3/02 |
| 96/12846 | 5/1996 | (WO) | D06P/3/02 |
| 98/46820 | 10/1998 | (WO) | D06P/5/15 |

OTHER PUBLICATIONS

Institute for Local Self–Reliance (ILSR), Factsheet 5: "Biochemical Substitution in the Pulp and Paper Industry", FS–5 ©1995 The Institute for Local Self–Reliance, All Rights Reserved, 3 Pages.

Ishihara, A., "Decolorization of Dyes by Laccase", 1997, pp. 1–10 (including original Japanese Transcript).

Metals in Biology and Medicine, "Centre for the Study of Metals in Biology and Medicine: Information Sheet", *Life Sciences*, 6 Pages, Nov. 18, 1998.

Networks of Centres of Excellence, "Keeping wood and paper production green", *Impact: Currently Funded Networks, Mechanical Wood–Pulps Network*, Copyright, Networks of Centres of Excellence, Jun. 5, 1998.

SciFinder, "Discharge Printing using Enzymes", Sep. 2, 1998, Copyright 1998 ACS, 2 Pages.

Abstract JP 62 238890 A (Canon KK); Oct. 19, 1987.

Abstract JP 63 021989 A (Canon KK); Oct. 29, 1988.

Abstract JP 63 066386 A (Canon KK); Mar. 25, 1988.

*Primary Examiner*—Yogendra N. Gupta
*Assistant Examiner*—Derrick G. Hamlin
(74) *Attorney, Agent, or Firm*—Steven D. Flack

(57) ABSTRACT

A method of decolorizing a dyed material in a predetermined pattern, which method involves providing a dyed material and ink jet printing a solution of an oxidoreductase onto the dyed material in a predetermined pattern. The present invention further provides a dyed material which has been decolorized in a predetermined pattern by a method of the present invention. The dyed material may be, for example, a dyed textile. Also provided is a method of simultaneously decolorizing and printing on a dyed material in a predetermined pattern. The method involves providing a dyed material and ink jet printing on the dyed material in a predetermined pattern with an ink jet ink which contains an oxidoreductase and one or more dyes which are not significantly decolorized by the oxidoreductase. The oxidoreductase may be, for example, a laccase, peroxidase, or diaphorase. If desired, the dyed material may be heated after printing the solution of an oxidoreductase or an oxidoreductase-containing ink jet ink thereon.

11 Claims, No Drawings

METHOD OF DECOLORIZING A DYED MATERIAL IN A PREDETERMINED PATTERN

This application claims priority from U.S. Provisional Application No. 60/117,443 filed on Jan. 26, 1999.

FIELD OF THE INVENTION

The present invention relates to dyed materials, such as dyed textiles. More particularly, the present invention relates to decolorizing dyed materials.

BACKGROUND OF THE INVENTION

The ink jet method of printing is a rapidly growing, commercially important printing process because of its ability to produce economical, high quality, multi-colored prints. Ink jet printing is becoming the method of choice for producing colored hard copy of computer generated images consisting of graphics and fonts in both narrow and wide format.

Current ink jet printing technology involves forcing ink drops through small nozzles by piezoelectric pressure, thermal ejection, or oscillation onto the surface of a material. An aqueous ink of low viscosity consisting of direct dyes or acid dyes is commonly used in ink jet printing. More specifically, the ink used in ink jet printing typically consists of an aqueous solution of dye, a humectant, and a pH buffer. These formulations are desirable because of their low cost, availability, safety, and environmental friendliness. In ink jet printing, uniformly shaped droplets of the aqueous formulation are ejected from a nozzle as very small drops onto a printing material. The printing material should allow for printing of round, well-shaped dots of high optical density. The material should control feathering (spreading) of the ink drops and absorb the ink vehicle rapidly (fast dry time) while adsorbing the dye at the surface to give sharp high density prints.

Ink jet printing of textiles is a relatively new technology that is gaining acceptance in the textile community. There are, however, several technical challenges associated with such ink jet printing. As noted above, ink jet printing almost universally requires the use of aqueous inks based on water-soluble dyes. Consequently, these dye-based inks are transparent. When an ink jet ink is printed on a textile which already has been dyed with a color darker than the color of the ink jet ink to be printed, the ink jet ink either cannot be detected visually or is too faint. Moreover, the underlying color of the textile, even if it is not darker than the ink jet ink to be printed, often alters the perceived hue of the printed ink jet ink. If the textile were selectively decolorized, the ink jet ink could be printed on the decolorized areas, thereby avoiding the problems just described. Although ink compositions based on nonaqueous systems are being developed for use in ink jet printing of textiles, such compositions are not known to be widely used; see, by way of example only, European Patent Specificaton Nos. EP 0 757 731 B1 and EP 0 778 907 B1 to Videojet Systems International, Inc.

The decolorization of dyed textiles is, of course, well known. By way of example, the enzymatic discharge printing of dyed textiles is described in Published International Application WO 98/46820 to Novo Nordisk Biochem North America, Inc. [see, also, Published International Applications WO 96/12845 and WO 96/12846 to Novo Nordisk A/S, both of which relate to enzymatic bleaching processes; Published International Application WO 96/10079 to Novo Nordisk A/S, which relates to enhancing agents, detergent additives, and detergent compositions; Published International Application WO 98/05816 to Novo Nordisk Biochem North America, Inc., which relates to an enzymatic method for overdying cellulosic textiles; and the Japanese article published in *Shizuoka-ken Hamamatsu Kogyo Gijutsu Senta Kenkyu Hokoku* (1997), 7, 21–26]. In the disclosed method, a dyed fabric is contacted with a phenol oxidizing system and an enhancing agent to selectively discharge dye from the fabric at selected areas. The phenol oxidizing enzyme is selected from the group consisting of peroxidase, laccase, catechol oxidase, bilirubin oxidase, and monophenol monooxygenase. The enzyme and enhancing agent may be applied to the fabric concurrently or separately in any order.

In the examples, discharge images were produced on dyed fabric by means of a manual screen printing method. A suitable silk screen design was prepared and the screen was placed on top of the fabric. A paste of the phenol oxidizing enzyme (laccase) and the enhancing agent (10-phenothiazine-propionic acid) was forced through the silk screen design onto an adjacent piece of fabric, resulting in the transfer to the fabric of the pattern of the screen.

While not directly related to the above method, U.S. Pat. No. 5,480,801 to Wahleithner et al.; U.S. Pat. No. 5,770,419 to Feng et al.; and Published International Applications WO 98/27197 and WO/9827198 to Novo Nordisk A/S are of interest as they relate to various laccases.

Enzymes also have been used to remove excess dye from textiles. See, by way of illustration only, European Patent Specification EP 0 580 707 B1 to Novo Nordisk A/S. According to the reference, it has been found possible to decolorize dye leached from dyed or printed textiles in an aqueous solution by adding enzymes utilizing hydrogen peroxide or molecular oxygen for the oxidation of organic or inorganic substances, including colored substances, together with a source of hydrogen peroxide or oxygen.

Several processes are described including a process for simultaneous bleaching of dye and formation of localized color variation in fabrics or garments made from differently colored materials; a process for inhibiting backstaining of denim garments during finishing; and a process for simultaneous removal of excess dye and removal of starch from newly manufactured printed or dyed fabric or yarn. Enzymes suitable for such processes are oxidases and peroxidases, collectively referred to as bleaching enzymes. Examples of such enzymes include catechol oxidase, laccase, peroxidase, chloride peroxidase, and phenol oxidase. It therefore can be seen that there is still a need in the art for a method for decolorizing a material in a predetermined pattern.

SUMMARY OF THE INVENTION

The present invention addresses some of the difficulties and problems discussed above by providing a method of decolorizing a dyed material in a predetermined pattern, which method involves providing a dyed material and ink jet printing a solution of an oxidoreductase onto the dyed material in a predetermined pattern. By way of illustration, the oxidoreductase may be a laccase, peroxidase, or diaphorase. For example, the oxidoreductase may be a laccase. If desired, the dyed material may be heated after printing the solution of an oxidoreductase thereon.

The present invention also provides a method of decolorizing a dyed material in a predetermined pattern, in which the method involves providing a dyed material; ink jet printing a solution of an oxidoreductase onto the dyed material in a predetermined pattern; and heating the dyed material after printing the solution of an oxidoreductase thereon. Again, the oxidoreductase may be a laccase, peroxidase, or diaphorase. For example, the oxidoreductase may be a laccase.

The present invention further provides a dyed material which has been decolorized in a predetermined pattern by a method of the present invention. The dyed material may be, for example, a dyed textile.

The present invention additionally provides a method of simultaneously decolorizing and printing on a dyed material in a predetermined pattern, in which the method involves providing a dyed material and ink jet printing on the dyed material in a predetermined pattern with an ink jet ink which contains an oxidoreductase and one or more dyes which are not significantly decolorized by the oxidoreductase. By way of illustration, the oxidoreductase may be a laccase, peroxidase, or diaphorase. For example, the oxidoreductase may be a laccase. If desired, the dyed material may be heated after printing the oxidoreductase-containing ink jet ink thereon.

DETAILED DESCRIPTION OF THE INVENTION

As used herein, the term "decolorizing" refers to a lessening of the intensity of color in a dyed material, such as a dyed textile. Such lessening may be partial or complete. When decolorization is complete, the dye is rendered colorless in the areas to which the oxidoreductase has been applied by ink jet printing.

The term "dyed material" is used herein to mean any material as defined hereinafter which has been dyed with one or more dyes which are capable of being decolorized by an oxidoreductase. Thus, the material has been dyed with one or more dyes which are substrates, or molecules on which the enzyme exerts catalytic action, for the oxidoreductase.

The term "dyed" is used herein to mean the act of imparting color to a material. This term should be recognized to encompass traditional methods of dyeing as well as staining or other nontraditional methods of imparting color.

The term "ink jet printing" is used herein to mean any imaging process by which ink drops are forced through small nozzles by piezoelectric pressure, thermal ejection, or by oscillation onto the surface of a material as described hereinbefore.

As used herein, the term "oxidoreductase" means any enzyme that catalyzes oxidation-reduction reactions and decolorizes certain types of water-soluble dyes employed in ink jet inks. All oxidoreductases have an E.C. (enzyme class) number of 1. For example, the E.C. number of laccase is 1.10.3.2, while the E.C. number for peroxidase is 1.11.1.7.

The term "material" is used broadly herein to mean any material upon which an ink jet image may be printed. Examples of suitable materials include, by way of illustration only, paper, films, nonwoven webs, and textiles. Textiles may be knitted or woven materials and may be prepared from naturally occurring fibers, synthetic polymer fibers, or blends thereof. Naturally occurring fibers include, for example, silk, wool, cotton, flax, jute, and ramie. Synthetic polymer fibers include but are not limited to regenerated cellulose (rayon), acetate, cellulose triacetate, polyamides (nylons), polyacrylonitriles, polyacrylates, and polyesters.

As noted earlier, the present invention provides a method of decolorizing a dyed material in a predetermined pattern, which method involves providing a dyed material and ink jet printing a solution of an oxidoreductase onto the dyed material in a predetermined pattern. By way of illustration, the oxidoreductase may be a laccase, peroxidase, or diaphorase. For example, the oxidoreductase may be a laccase. In general, the amount of the oxidoreductase present on the material should be an amount sufficient to effect the desired degree of decolorization. For example, the amount of the oxidoreductase may be from about 0.001 $\mu$g to about 10,000 $\mu$g of enzyme protein per gram of material. As another example, such amount may be from about 0.01 $\mu$g to about 1,000 $\mu$g of enzyme protein per gram of material. As a further example, such amount may be from about 0.1 $\mu$g to about 100 $\mu$g of enzyme protein per gram of material.

If desired, the dyed material may be heated after printing the solution of an oxidoreductase thereon. Heating generally may be accomplished at a temperature just above ambient temperature to about the temperature at which the enzyme protein is denatured. For example, heating may be at a temperature of from about 30° C. to about 120° C. As a further example, heating may be at a temperature of from about 30° C. to about 100° C. As another example, heating may be at a temperature of from about 40° C. to about 100° C.

The time period over which decolorization takes place in general is a function of enzyme concentration and material temperature. There are, of course, other factors, such as, by way of illustration only, the pH of the enzyme solution and the presence of cofactors and/or coenzymes, activators, enhancers, and/or surfactants. Enzyme decolorization periods typically may vary from minutes to days.

The present invention also provides a method of decolorizing a dyed material in a predetermined pattern, in which the method involves providing a dyed material; ink jet printing a solution of an oxidoreductase onto the dyed material in a predetermined pattern; and heating the dyed material after printing the solution of an oxidoreductase thereon. Again, the oxidoreductase may be a laccase, peroxidase, or diaphorase. For example, the oxidoreductase may be a laccase.

The present invention additionally provides a method of simultaneously decolorizing and printing on a dyed material in a predetermined pattern, in which the method involves providing a dyed material and ink jet printing on the dyed material in a predetermined pattern with an ink jet ink which contains an oxidoreductase and one or more dyes which are not significantly decolorized by the oxidoreductase. By way of illustration, the oxidoreductase may be a laccase, peroxidase, or diaphorase. For example, the oxidoreductase may be a laccase. If desired, the dyed material may be heated after printing the oxidoreductase-containing ink jet ink thereon.

Because of the specificity of enzymes, it is possible to add the oxidoreductase to an ink jet ink which includes dyes which are not susceptible to the oxidoreductase; that is, the dyes in the ink are not substrates for the enzyme. Consequently, the enzyme will decolorize the dye present on the dyed material to allow the newly printed dyes to predominate in the printed areas of the predetermined pattern. By this means the simultaneous selective decolorization and selective dyeing of a material may be accomplished.

The present invention further provides a dyed material which has been decolorized in a predetermined pattern by a method of the present invention. The dyed material may be, for example, a dyed textile.

The present invention is further described by the examples which follow. Such examples, however, are not to be construed as limiting in any way either the spirit or the scope of the present invention. Unless stated otherwise, all percents are percents by weight.

For use in the initial examples, samples of a 100 percent cotton poplin fabric were dyed by two different methods, described below.

Method I

To 742.5 ml of hot (about 90° C.) deionized water heated on a hot plate was added 7.5 mg of a synthetic indigo dye (Catalog No. 22,929-6, Aldrich Chemical Company, Milwaukee, Wis.). The mixture was stirred to suspend the dye, resulting in a 1 percent indigo dye suspension. To the hot dye suspension was added an approximately 4 g, 5.5-inch by 10-inch (about 14-cm by 25.4-cm) piece of the cotton poplin. The poplin-dye mixture was removed from the hot plate and allowed to stand for about 20 minutes. The poplin was removed from the dye suspension, placed in 500 ml of water containing about 1 ml of detergent (Liquinox®), and agitated for 2–5 minutes. The colored poplin was rinsed in tap water and allowed to air dry overnight.

Method II

A sample of the cotton poplin as described in Method I was placed in deionized water, in this case, the poplin weighed about 30 g and was 36 inches by 11 inches (about 91 cm by about 28 cm). The poplin-water mixture was heated on a hot plate to approximately 80° C. for 45 minutes. The poplin was then rinsed in warm tap water and set aside. A 20-g portion of the synthetic indigo dye employed in Method I was weighed and added to a small amount of cold tap water to make a paste. To the resulting dye paste was added 800 ml of hot tap water. The mixture was stirred to suspend the dye. To a large metal container were added 1.5 liters of hot tap water, followed by the dye suspension. The resulting suspension was mixed using a large stirring rod. The poplin then was added to the dye suspension and stirred constantly for 10 minutes. The poplin was allowed to soak in the dye suspension for 2 hours, stirring occasionally. The poplin was removed from the dye suspension and rinsed in hot tap water for 2 minutes. The dyed poplin was washed in detergent-containing water as described for Method I for two minutes. The poplin then was rinsed in hot tap water for two minutes and then cold water until thoroughly rinsed. The dyed poplin sample was allowed to air dry and then steam pressed using a Singer Pro9s Professional press (Singer N.V., Murfreesboro, Tenn.).

EXAMPLE 1

This example describes the ink jet printing of a water-based enzyme solution onto indigo-dyed poplin.

A solution containing 100 mg/ml of Denilite® (Novo Nordisk, Franklinton, N.C.) in deionized water was prepared by adding 3.2 g of the Denilite® to 32.4 ml of deionized water and shaking. Denilite® is a commercially available enzyme product for the bleaching of dyed textiles, such as denim. The product contains laccase and the enhancing agent 10-phenothiazine-propionic acid and is described in PCT publications WO 96/12845 and WO 96/12846 which are incorporated herein by reference. The printing process described below was carried out with samples dyed by both Method I and Method II.

The solution was placed in an empty black ink cartridge (Part No. SO20093, Epson America Inc., Torrance, Calif.). The filled cartridge was installed in an Epson Stylus® Color 600Q ink jet printer. An approximately 4 inch×8 inch (about 10 cm×20 cm) portion of the indigo-dyed poplin was taped on all four sides with white laboratory tape to an 8.5 by 11-inch sheet piece of Kimberly bond paper (Kimberly-Clark Corporation, Neenah, Wis.); the sheet then was inserted into the printer. The enzyme was printed onto the fabric in a solid block pattern consisting of either a single 4-inch by 6-inch (about 10-cm by 15-cm) block or two 2-inch (about 5-cm) square blocks using Microsoft Paint software. The sheet was replaced in the printer and printed six more times to allow the sample to be saturated in the block pattern with the enzyme solution. The enzyme-printed portion of fabric was steamed with the Singer Pro9s Professional press (cotton setting, full steam) described above, pressing lightly for 1 to 2 minutes. A lightening of color was seen for all samples. The results are summarized in Table 1 which follows.

TABLE 1

Decolorizing Effect of Ink Jet Printed Enzyme Solution

| SAMPLE | DYEING METHOD | LIGHTENING TIME[a] |
|---|---|---|
| 1 | I | 2 days |
| 2 | II | 3 days[b] |
| 3 | II | 2 days |

[a]Elapsed time before lightening was observed.
[b]The sample was not observed until the third day.

EXAMPLE 2

This example describes the ink jet printing of an alternate water-based enzyme solution onto indigo-dyed poplin.

A solution containing 10 percent (100 mg/ml) of Denilite® was prepared by adding the Denilite® to a mixture consisting of 68.7 percent deionized water, 0.4 percent BIOBAN DXN (50 percent solids, Angus Chemical Co., Buffalo Grave, Iowa], 6 percent 2-pyrrolidone (ISP Technologies Inc., Wayne, N.J.), 0.1 percent Cobratec 99 (PMC Specialties Group, Inc., Cincinnati, Ohio), 12 percent Butylcarbitol, 0.4 percent Tris buffer, 0.4 percent triethanolamine (85 percent solids), and 2 percent isopropanol (all from Aldrich Chemical Company). The components other than the enzyme product often are employed in ink jet inks. The resulting enzyme solution was placed in an empty black ink cartridge as described in Example 1. Portions of dyed poplin then were printed with the enzyme solution as described in Example 1. A lightening of color was seen for all samples, as summarized in Table 2 which follows.

TABLE 2

Decolorizing Effect of Ink Jet Printed Alternative Enzyme Solution

| SAMPLE | DYEING METHOD | LIGHTENING TIME[a] |
|---|---|---|
| 1 | II | Immediately after steaming |
| 2 | II | Immediately after steaming |

[a]Elapsed time before lightening was observed.

In a final series of examples, the degree of optical lightening of the fabric resulting from use of the described enzyme solutions was measured quantitatively using L*, a*, b* optical values. The L*, a*, b* measurements were made of the printed textile substrates using a Hunter Model Miniscan XE spectrophotometric color measurement system, available from Hunter Associates Laboratory, Inc., of Reston, Va. The settings on the apparatus were at D50 illuminant, and an angle of 2°. Average optical values were taken as the sum of the average of three measurements. Delta E* was then calculated in accordance with the following equation:

$$\Delta E^* = \text{SQRT}[(L^*\text{standard} - L^*\text{sample})^2 + (a^*\text{standard} - a^*\text{ sample})^2 + (b^*\text{standard} - b^*\text{sample})^2]$$

It should be recognized that control samples were prepared, which formed the basis of the standard measurements described above. The control samples were the outside of the printed samples, i.e the areas of the samples which were not decolorized. The higher the calculated Delta E*, the greater the change in color intensity. A large increase in delta E* would typically be indicative of fading.

Additionally, the following "vat" dyeing method was used to dye the cotton poplin samples, rather than either of the two previously described dyeing techniques. In particular, the fabric consisted of a 55 g cotton fabric swatch of the same material of the prior examples. In preparation for the dyeing process, the fabric was first washed with a detergent, and in particular Tide® and then dried in a clothes dryer. It was later determined that this step should be avoided because the detergent contains optical whiteners and brighteners which can accentuate the observed effect.

Approximately 1.1 liters of water were first added into a large glass beaker. 5 g NaOH (in pellet form), 5 g RIT Color Remover (obtained from CPC Specialty Markets U.S.A., of Indianapolis, Ind.), and 2.2 g indigo dye (obtained from Aldrich) were added to the beaker and heated to between approximately 65–70° C. The observed solution turned green/yellow in color. The fabric swatch was then added, making sure that at all times the entire fabric sample was submerged the liquid. The beaker was stirred frequently. A total of 10 g NaCl was added to the beaker. A total of 10 g NaCl was gradually added to the beaker to assist exhaustion of the dye onto the fabric. After approximately 30–60 minutes, the fabric was removed and allowed to oxidize in the air. The fabric was then rinsed out of excess dye with cold tap water. The fabric sample was then soaped using an aqueous solution containing 2–3% soap (without whiteners). In particular Liquinox and 1–2% weight percent of soaping solution (specifically potassium carbonate) was used. Alternatively, sodium carbonate could have been used. The mixture was heated to approximately 70° C. for approximately 15–20 minutes. The heat was then removed and the mixture was allowed to sit for 1.5 hours. The fabric was then rinsed with tap water and hung to dry. A uniform indigo blue color was achieved in the fabric sample.

In order to determine whether the laccase can decolorize the indigo on the vat dyed cotton, the Denilite® was printed onto the newly dyed cotton and the effects were observed.

In preparation for the printing, a 100 mg/ml Denilite® mixture was made in an aqueous solution. In particular, 40.5 g of a solution consisting of 68.7 percent deionized water, 0.4 percent Bioban DXN (a biocide obtained from Angus Chemical Company of Buffalo Grave, Iowa), 6 percent 2-pyrrolidone (ISP Technologies Inc., Wayne, N.J.), 0.1 percent Cobratec 99 (PMC Specialties Group, Inc., Cincinnati, Ohio), 12 percent Butylcarbitol, 0.4 percent Tris buffer, 0.4 percent triethanolamine (85 percent solids), and 2 percent isopropanol (all from Aldrich Chemical Company). The above aqueous solution was mixed with 4.5 g Denilite® for a total of 45 g. The mixture was centrifuged for approximately 5 minutes at 2000 revolutions per minute. The filtrate was placed in an empty ink cartridge (black ink cartridge obtained from Epson as previously described). The indigo cotton dyed fabric was taped to Kimberly bond paper (obtained from Kimberly-Clark by using low adhesive tape along the outer edges. The enzyme was printed 8 times in a block pattern using Microsoft Paint software to achieve saturation using an Epson 600Q printer. Following printing, a Singer press, as previously described, was used on the cotton setting w/steam to steam treat half of the sample. The sample was then observed for color change. The Hunter apparatus was then used to read L*,a*,b* values after 3, 4 and 7 days. Table 3 illustrates the standard L*,a*,b* values using the Hunter apparatus, followed by Table 4 which illustrates the results of the vat dyed samples.

TABLE 3

| | L* | a* | b* |
|---|---|---|---|
| Standard | 41.28 | −5.581 | −20.15 |

TABLE 4

| | L* | a* | b* | DELTA L* | DELTA a* | DELTA b* | DELTA E* |
|---|---|---|---|---|---|---|---|
| 3 Days steam | 45.33 | −6.21 | −17.09 | 4.05 | −0.63 | 3.06 | 5.12 |
| 3 Days no steam | 42.88 | −6.43 | −18.05 | 1.60 | −0.85 | 2.10 | 2.78 |
| 4 Days steam | 45.62 | −6.25 | −17.08 | 4.34 | −0.67 | 3.07 | 5.36 |
| 4 Days no steam | 43.79 | −6.39 | −18.05 | 2.51 | −0.81 | 2.10 | 3.37 |
| 7 Days steam | 46.98 | −6.95 | −16.14 | 5.70 | −1.37 | 4.01 | 7.10 |
| 7 Days no steam | 45.22 | −7.02 | −17.04 | 3.94 | −1.44 | 3.11 | 5.22 |

The Denilite® with laccase successfully decolorizes as demonstrated by the increasing Delta E* values in Table 4.

As shown by the above examples, the advantage of the method of the present invention is that it provides a simple and quick way, using environmentally friendly enzymes, to decolorize a dyed textile in a predetermined pattern. Such method is much more efficient than the known method which employs a silk screen and a discharge paste. Ink jet printing allows for the changing of a desired pattern digitally, providing a quick and easy alternative to discharge printing in which a separate screen must be made for each pattern. Also, ink jet discharge printing is less wasteful in that only a small amount of the solution is laid down on the substrate, covering only the targeted pattern areas.

While other methods for decolorizing a fabric are known, they generally rely on chemical bleaching agents. The use of enzymes provides an environmentally friendly alternative in that enzymes are naturally occurring proteins which are nontoxic, used under milder conditions, and biodegradable. Also, enzymes are very specific in the type of reactions they catalyze. Therefore, an ink jet printing solution containing enzymes can differentiate between the type of dye that it decolorizes as well as promote less injury to the textile fibers being treated.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of decolorizing a dyed material in a predetermined pattern, the method comprising:

providing a dyed material; and ink jet printing a solution of an oxidoreductase onto the dyed material in a predetermined pattern.

2. The method of claim 1, which further comprises heating the dyed material after printing the solution of an oxidoreductase thereon.

3. The method of claim 1, in which the oxidoreductase is laccase, peroxidase, or diaphorase.

4. The method of claim 3, in which the oxidoreductase is laccase.

5. A method of decolorizing a dyed material in a predetermined pattern, the method comprising:

providing a dyed material;

ink jet printing a solution of an oxidoreductase onto the dyed material in a predetermined pattern; and heating the dyed material after printing the solution of an oxidoreductase thereon.

6. The method of claim 5, in which the oxidoreductase is laccase, peroxidase, or diaphorase.

7. The method of claim 6, in which the oxidoreductase is laccase.

8. A method of simultaneously decolorizing and printing on a dyed material in a predetermined pattern, the method comprising:

providing a dyed material; and ink jet printing on the dyed material in a predetermined pattern with an ink jet ink which contains an oxidoreductase and one or more dyes which are not significantly decolorized by the oxidoreductase.

9. The method of claim 8, which further comprises heating the dyed material after printing the oxidoreductase-containing ink jet ink thereon.

10. The method of claim 8, in which the oxidoreductase is laccase, peroxidase, or diaphorase.

11. The method of claim 10, in which the oxidoreductase is laccase.

* * * * *